US009944481B2

(12) United States Patent
Green

(10) Patent No.: US 9,944,481 B2
(45) Date of Patent: Apr. 17, 2018

(54) METHOD AND SYSTEM FOR DETERMINING USAGE OF A ROLLED OR STACKED PRODUCT

(71) Applicant: Kimberly-Clark Worldwide, Inc., Neenah, WI (US)

(72) Inventor: Jonathan Green, Warlingham (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 14/915,320

(22) PCT Filed: Feb. 25, 2015

(86) PCT No.: PCT/US2015/017431
§ 371 (c)(1),
(2) Date: Feb. 29, 2016

(87) PCT Pub. No.: WO2016/137450
PCT Pub. Date: Sep. 1, 2016

(65) Prior Publication Data

US 2017/0369262 A1 Dec. 28, 2017

(51) Int. Cl.
*B65H 7/14* (2006.01)
*A47K 10/42* (2006.01)
(Continued)

(52) U.S. Cl.
CPC ..... *B65H 7/14* (2013.01); *A47K 10/3612* (2013.01); *A47K 10/424* (2013.01);
(Continued)

(58) Field of Classification Search
CPC ..... G06F 19/3462; G06F 19/3456; G07F 17/0092; G07F 9/026; A61J 7/02
(Continued)

(56) References Cited

U.S. PATENT DOCUMENTS 5,427,161 A * 6/1995 Luhmann ..... B67C 3/204 141/1
7,930,064 B2 * 4/2011 Popovich, Jr. ..... G07F 17/0092 221/2
(Continued)

FOREIGN PATENT DOCUMENTS

JP 04-00723 A 1/1992
JP 05-147327 A 6/1993
(Continued)

OTHER PUBLICATIONS

PCT Search Report and Written Opinion, dated Oct. 29, 2015.

*Primary Examiner* — Timothy R Waggoner
*Assistant Examiner* — Ayodeji T Ojofeitimi
(74) *Attorney, Agent, or Firm* — Dority & Manning, P.A.

(57) ABSTRACT

A system and control method are provided for determining an amount of a product dispensed from or added to a product formation. At defined intervals, a mark is projected with a light source imager onto an aspect of the product formation that changes as the amount of product is depleted or added to the product formation. A digital image is taken of the aspect of the product formation that captures the projected mark and is transmitted to a digital imager processor, wherein a feature of the projected mark is analyzed that changes as the product formation decreases or increases in size as the product is dispensed or added. The analyzed feature is compared with a predetermined value of the feature at a predefined size of the product formation to determine an actual amount of the product on the product formation, or amount of product depleted from or added to the product formation.

15 Claims, 7 Drawing Sheets

(51) Int. Cl.
*B65H 26/06* (2006.01)
*B65H 43/02* (2006.01)
*A47K 10/36* (2006.01)

(52) U.S. Cl.
CPC ..... *B65H 26/066* (2013.01); *B65H 43/02* (2013.01); *B65H 2220/03* (2013.01); *B65H 2404/143* (2013.01); *B65H 2511/142* (2013.01); *B65H 2511/152* (2013.01); *B65H 2511/413* (2013.01); *B65H 2553/42* (2013.01); *B65H 2557/11* (2013.01); *B65H 2557/512* (2013.01); *B65H 2701/124* (2013.01); *B65H 2701/1924* (2013.01)

(58) Field of Classification Search
USPC ..... 700/236; 221/2, 7, 9, 10, 11; 222/64–66
See application file for complete search history.

(56) References Cited

U.S. PATENT DOCUMENTS

| | | | | |
|---|---|---|---|---|
| 2007/0176040 | A1 | 8/2007 | Asikainen | |
| 2009/0183796 | A1* | 7/2009 | Chase | B67D 1/001 141/1 |
| 2009/0314801 | A1* | 12/2009 | Ashrafzadeh | B67D 1/0858 222/64 |
| 2010/0155415 | A1* | 6/2010 | Ashrafzadeh | B67D 1/001 222/1 |
| 2014/0367401 | A1* | 12/2014 | Stralin | A47K 10/22 221/6 |

FOREIGN PATENT DOCUMENTS

| | | | |
|---|---|---|---|
| JP | 09-040252 | A | 2/1997 |
| JP | 2001-187662 | A | 7/2001 |

* cited by examiner

METHOD AND SYSTEM FOR DETERMINING USAGE OF A ROLLED OR STACKED PRODUCT

FIELD OF THE INVENTION

The present invention relates generally to methods and systems for determining the amount of a product that is depleted or dispensed form a rolled or stacked configuration of the product, for example in the consumable paper products environment wherein rolled or stacked tissues and towels are dispensed from a dispenser.

BACKGROUND

With various manufacturing processes, a work material, such as a continuously running web or sheet material, is added to or depleted from a product formation. For example, in a paper mill, the formed paper web is continuously added to a rolled product formation. The web may then be unwound from the rolled product formation in the process of making other products, such as consumable paper products. For various manufacturing and quality control reasons, it is often necessary to know how much of the product remains on the product formation, or has been depleted from the product formation, without stopping or otherwise adversely affecting the manufacturing line.

The above issue also applies to the dispensing of a wide variety of consumable products. Whether for private home use or public use, the dispensing of paper products such as towels and tissues has resulted in many different types of manual and automatic dispensing devices for controlling quantities dispensed, as well as for determining how much of the paper product has been dispensed. For example, U.S. Pat. No. 7,780,380 describes a dispenser of stacked paper products (e.g., folded and stacked napkins or paper towels) wherein a sensor unit is carried by an inner side wall of the dispenser housing and is used for detecting when refill of the dispenser is needed. The sensor unit uses an infrared sensor to detect when a stack of the paper product falls below a low paper point. A narrow beam of infrared light is sent from an emitter and is picked up by an adjacent detector. When the top of the paper stack lies above the infrared sensor, the detector does not pick up infrared light. However, when the top of the paper stack falls below the infrared sensor, light from the emitter is visible to the detector and an appropriate low paper warning is generated.

The U.S. '380 patent also describes an automatic rolled product dispenser that detects the presence of a user and automatically dispenses a measured sheet of paper product. A mechanical lever is arranged on a pivot at one end and rests on the roll at the other end. A micro-switch or variable resistor located near the pivot detects changes in the pivoted position of the lever as the roll diameter decreases and generates a corresponding signal to a sensor unit that generates an indication of the amount of paper product remaining in the dispenser.

Other types of detection mechanisms are also suggested in the U.S. '380 patent, including purely electrical systems, purely mechanical systems, electro-mechanical systems, capacitive systems, and ultrasonic systems. Capacitive proximity sensors produce an electrostatic field that can sense paper and other non-metallic objects as well as metallic objects. Ultrasonic proximity sensors use a transducer to send and receive high frequency sound signals. The reflected sound has a shorter path when the paper is in proximity to the sensor.

Thus, the industry is continuously seeking new and improved dispensing systems that can accurately determine usage of the product without prohibitively adding to the cost of the dispenser or adversely affecting the product dispensing operation. It would be a significant benefit if the usage determination system and method could function without requiring physical alteration or modification of the monitored product.

SUMMARY OF THE INVENTION

Objects and advantages of the invention will be set forth in part in the following description, or may be obvious from the description, or may be learned through practice of the invention.

Embodiments of the present system and method will be described herein with reference to consumable paper product dispenser systems for illustrative purposes only. It should be appreciated that the present invention is not limited to such environment and encompasses any use or application wherein the amount or rate of product used (or remaining) is determined in accordance with the principles set forth herein. For example, the invention may have utility in various mills or other manufacturing systems wherein products are wound or unwound from a continuously operating roll, such as a paper mill, toilet tissue or paper towel manufacturing line wherein such products are wound from larger rolls, rolled sheet metal manufacturing lines, textile mills, and so forth.

In accordance with aspects of the invention, a method is provided for determining an amount of product in product formation, such as a rolled or stacked formation, wherein the product is being depleted from or added to the product formation in a continuous or periodic manner. The method includes, at defined intervals, projecting a mark with a light source imager onto an aspect of the product formation that changes as the amount of product is depleted or added to the product formation. A digital image is taken of the aspect of the product formation that captures the projected mark, with the digital image transmitted to a digital imager processor. With the digital image processor, a feature of the projected mark is analyzed that changes as the product formation decreases or increases in size as the product is dispensed from or added to the product formation. The analyzed feature is compared with a predetermined value of the feature at a predefined size of the product formation to determine an actual amount of the product on the product formation, or amount of product depleted from or added to the product formation.

The system for performing the product determination may be integral to a manufacturing or dispensing machine, or may be a portable unit that can be brought to a production/depletion location on an as-needed basis.

In particular embodiments, the analyzed feature is a dimensional value (e.g., length, radius, height, etc.) or pixel count of the projected mark that changes as the product formation decreases or increases in size, wherein a changing pixel count or dimensional value of the projected mark is a measure of the amount of product added or deleted from the product formation.

In one embodiment, the projected mark is a shadow mark produced by the light source imager against a sufficiently brighter background of the product formation in the digital image, wherein the shadow mark produces definable pixels that are detectable by the digital image processor for determining the pixel count or dimensional value of the shadow mark.

In an alternate embodiment, the projected mark is bright mark produced by the light source imager against a sufficiently darker background of the product formation in the digital image, wherein the bright mark produces definable pixels that are detectable by the digital image processor for determining the pixel count or dimensional value of the shadow mark.

The systems and methods are not limited any particular shape or configuration of product formation. In certain embodiments, the product formation is a rolled or stacked product, and the digital image is taken of a side of the product formation that changes in size as the product formation decreases or increases in size. For example, the product formation may be a stack of folded products, with the projected mark extending from a lower bottom portion of the stack towards an upper edge of the stack. Alternatively, the product formation may be a roll of continuous product, with the projected mark extending radially from a center portion of the side towards a circumferential edge of the roll.

The present systems and methods may have particular usefulness in dispenser systems, particular consumable paper product dispenser systems. In this regard, a dispenser system and method are provided for determining an amount of paper product dispensed from a dispenser or remaining in the dispenser, wherein the paper product is initially loaded in the dispenser as a paper product formation, such as a roll of a continuous tissue or paper towels, or a stack of folded napkins. It should be understood that the present system and method are not limited to a particular type or configuration of dispenser, or type of paper product dispensed. The inventive systems and methods are, however, particularly useful when integrated with consumable paper product dispensers (e.g., manual or automatic toilet tissue dispensers, paper towel dispensers, and folded napkin dispensers) typically found in an "away-from-home" public or semi-private environment. As used herein, the term "away-from-home" means a place or location where people congregate for various reasons or purposes that are outside the typical home. Examples of away-from-home locations include places of business, such as office buildings, office suites, retail stores, and warehouses, manufacturing facilities; schools; hospitals and other types of medical facilities; places of worship; hotels and motels; conference centers; and the like. The system is particularly useful in structures wherein multiple washroom facilities are provided for use of the building tenants or an industrial or manufacturing site wherein multiple site facilities are provided for a controlled populace. It should be appreciated though that the present washroom system may prove useful in a residential or private environment, and such uses are within the scope and spirit of the invention.

The method includes, at defined intervals, projecting a mark with a light source onto an aspect of the paper product formation within the dispenser that changes as the paper product is dispensed from the dispenser. A digital image is taken of the aspect of the paper product formation that captures the projected mark, with the digital image to a digital imager processor. With the digital image processor, a feature of the projected mark is analyzed that changes as the paper product formation decreases in size as the paper product is dispensed. The analyzed feature is compared with a predetermined value of the feature at a predefined size of the paper product formation, which allows the processor (including associated hardware and software) to determine an amount of the paper product that has been dispensed from or remains in the dispenser.

The method is particularly beneficial when implemented with a paper towel or toilet tissue dispenser.

The general features discussed above are applicable to various paper product dispenser-implemented embodiments, as discussed in greater detail below.

With the dispenser embodiments, the digital image may be taken by a digital imager configured within the dispenser housing. The imager may be hard-wired to a digital image processor that is dedicated to the dispenser and located in or near the dispenser. Alternatively, the imager may be in wireless communication with a remote processor that is common to a plurality of different dispensers. The remote processor may be located at a monitoring station for a "smart washroom" within a commercial building, such as an office building, wherein the dispensers at the functional locations (e.g., sinks, toilets, changing closets, etc.) are remotely monitored as to availability or operational status.

Using the digital image processor, a feature of the digital image is analyzed that changes as the paper product formation decreases in size with depletion of the paper product. The digital image process compares the analyzed feature with a predetermined value of the feature at a predefined size of the paper product formation,

DETAILED DESCRIPTION OF THE INVENTION

Figure 1:
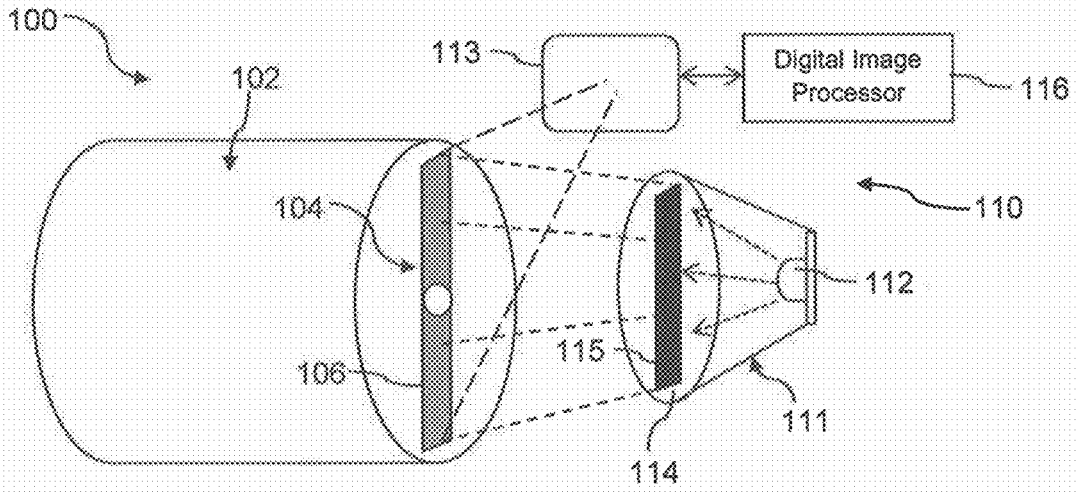
FIG. 1 is a diagram view of an operational principle for projecting a measurable shadow mark onto the side of a rolled product formation.

Reference will now be made in detail to one or more embodiments of the invention, examples of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

As mentioned, the present systems and methods have utility in any environment wherein it is desired to determine the amount of product depleted from or remaining in product formation, particularly if the product formation is in continuous or semi-continuous use, such as being added to or depleted from during a production process. Such environments may include, for example, textile or paper/pulp mills wherein the product is wound into a continuous rolled product formation, or a sheet metal manufacturing line wherein the metal product is wound into rolls, and so forth. The systems and methods are not limited by the type or configuration of product formation, or environment in which the systems and methods have utility.

Figure 2:
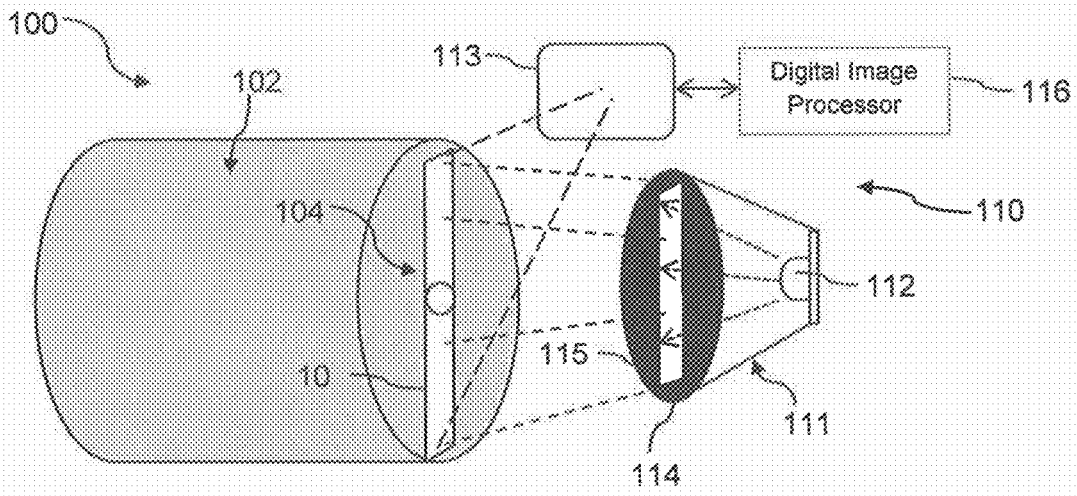
FIG. 2 is a diagram view of an operational principle for projecting a measurable bright mark onto the side of a rolled product formation.

FIGS. 1 and 2 illustrate basic operational principles of a system and associated method 100 in accordance with the present disclosure. A product formation 102 is depicted as a rolled product formation wherein the product is wound onto or depleted from the formation 102 during a manufacturing or use process. A mark 104 is projected onto an aspect of the product formation 102 that changes as the amount of product is depleted or added to the product formation 102. For example, as the rolled product formation 102 increases or decreases in size, the diameter or radius aspect of the product formation 102 will change accordingly. The mark 104 is projected onto the product formation 102 by a digital imaging system 110 that may be variously configured. In general, the digital imaging system 110 includes a projector 111 that generates a mark 104 on the product formation 102. The projection 11 includes a light source 112, such as an array of one or more LED lights, and a mask 114 through which the light is passed or blocked. In the embodiment of FIG. 1, the mask 114 includes a stripe black-out section 115 that blocks transmission of light from the light source 112 while passing light through the remaining portions of the mask 114. Thus, a stripe shadow mark 106 is projected onto the side of the product formation 102. In the embodiment of FIG. 2, the mask 114 includes a stripe cut-out section through the mask 114 through which light passes surrounded by a black-out section that blocks transmission of light from the light source 112. Thus, a stripe bright mark 108 is projected onto the product formation 102.

The digital imaging system 110 includes a digital camera 113 having a defined imaging field that captures a digital image of the projected mark 104, with the digital image being transmitted to a digital imager processor 116 that may be integral with or remote from the camera 113. With the digital image processor 113, a feature of the projected mark 104 is analyzed that changes as the product formation 102 decreases or increases in size as the product is dispensed from or added to the product formation 102. For example, in the embodiments of FIGS. 1 and 2, the feature of the projected mark may be the length of the mark 104 or a total pixel count of the mark 104. The analyzed feature is compared with a predetermined value of the feature at a predefined size of the product formation 102 to determine an actual amount of the product on the product formation 102. With this information, an amount of product depleted from or added to the product formation 102 is readily determined.

In the embodiment of FIG. 1, the projected mark 104 is a shadow mark 106 produced by the light source 112 against a sufficiently brighter background of the product formation 102 in the digital image such that shadow mark 106 produces definable pixels that are detectable by the digital image processor 113 for determining the pixel count or dimensional value of the shadow mark 106. The product formation 102 may have a sufficiently brighter background due to the nature of the product (e.g., white paper), or the brighter background may be enhanced by light from the light source 112 passing through the mask 114 around the black-out stripe section 115.

In the embodiment of FIG. 2, the projected mark 104 is a bright mark 108 produced by the light source 112 against a sufficiently darker background of the product formation 102 in the digital image such that bright mark 108 produces definable pixels that are detectable by the digital image processor 113 for determining the pixel count or dimensional value of the bright mark 108. The product formation 102 may should have a sufficiently dark background to ensure the required degree of pixel value differential between the bright mark 108 and product formation 102.

Figure 3:
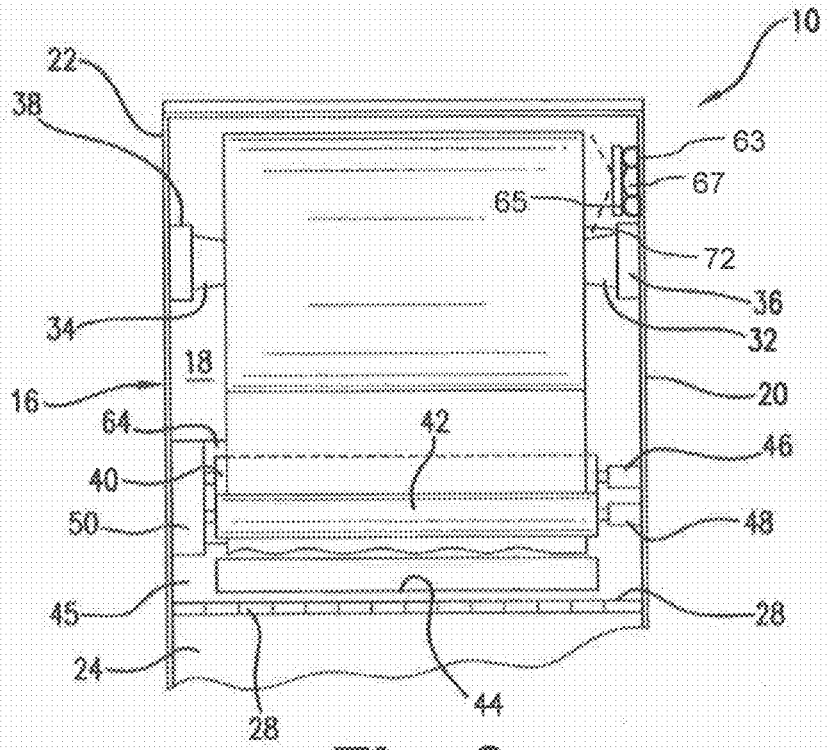
FIG. 3 is a front cut-away view of a rolled product dispenser incorporating a digital imager in accordance with system and method aspects of the present invention.
Figure 4:
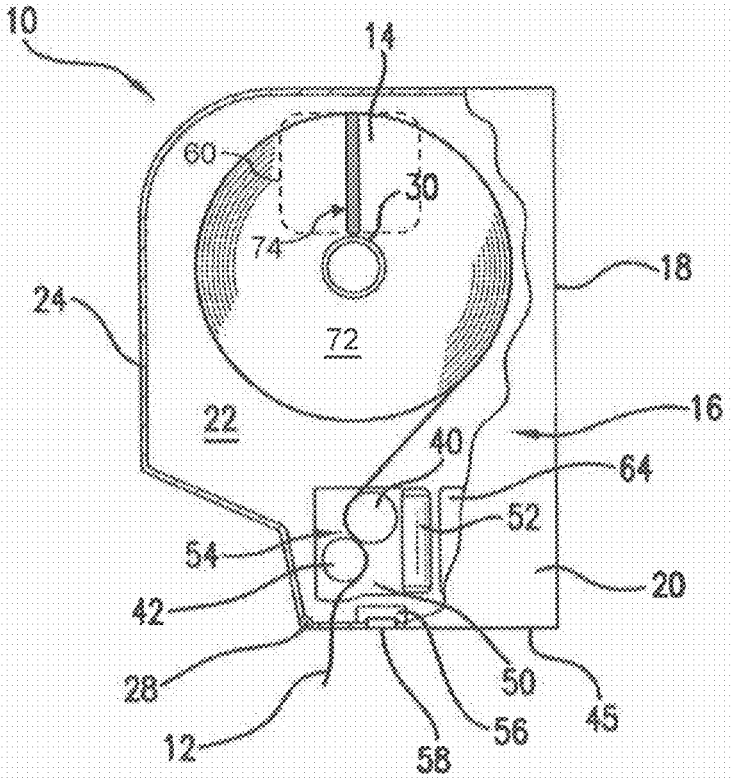
FIG. 4 is a side cut-away view of the dispenser of FIG. 1 and indicates the field of a digital image obtained by the digital imager and a projected mark on the side of the rolled product formation.

As mentioned, the present systems and methods are particularly useful when implemented with consumable product dispensers, such as paper towel or tissue dispensers. In this regard, various embodiments of exemplary dispensing systems and methods are depicted in FIGS. 3 through 9. With reference to FIGS. 3 and 4, an automatic electronic dispenser system 10 is illustrated for dispensing a paper product in the form of sheet material 12 from a paper product formation 14 loaded into the dispenser, such as a continuous roll of the sheet material. The paper product 12 in this embodiment is an absorbent web material, such as paper toweling or toilet tissue, and so forth, which may be perforated for separation. The dispenser system 10 includes a dispenser housing 16 having a back panel 18 mountable to a wall or similar vertical surface, a pair of opposed side panels 20 and 22, and a front cover 24. The front cover 24 may be pivotally connected to a lower portion of the housing 16 with hinges 28 so as to be movable between a closed condition and an open condition. The front cover 24 of the dispenser housing 16 typically is opened for servicing or for loading a replacement sheet material roll 14 into the dispenser 10. A latch (not shown) allows the front cover 24 to be locked in the closed condition so as to avoid unauthorized tampering with the dispenser components within the housing 16.

The rolled product formation ("roll") 14 may include a core or sleeve 30, or may be a coreless roll, such as that disclosed in U.S. Pat. No. 5,620,148. The roll 14 may be rotatably supported within the housing 16 by a pair of mounting hubs 32 and 34 which, in the illustrated embodiment are connected to the side panels 20 and 22 of the housing 16 by means of roll holders 36 and 38. The outer circumference of the sheet roll 14 may be supported by a portion of the housing without other support for unwinding of the roll 14, as disclosed for example in U.S. Pat. No. 6,224,010. It will be appreciated, however, that the housing 16 may be provided as a separate unit with few or no mechanisms connected thereto. In this instance, some or all of the dispensing mechanisms shown and/or described herein may be provided as one or more modules which are inserted into the housing. Examples of such dispenser housings and modules are disclosed in U.S. Pat. Nos. 4,131,044 and 6,079,035.

As depicted in FIGS. 3 and 4, the sheet material 12 runs off the roll 14, between a pair of rollers 40 and 42, and through a dispensing opening 44, for example, in a lower end 45 of the housing 16. Alternatively, the dispensing opening may be formed in the front cover, or in both a portion of the front cover and a portion of the lower end (not shown). The opening 44 may have a serrated edge, or it may carry teeth for severing the web of sheet material (if the material 12 is not perforated). One end of the roller 40 may be rotatably mounted to the side panel 20 of the housing 16 by means of a roll holder 46, and one end of the roller 42 may be rotatably mounted to the side panel 20 of the housing 16 by means of a roll holder 48. The other ends of the rollers 40 and 42 may be rotatably mounted to the side panel 22 by means of roll holders concealed within a transmission housing 50. The transmission housing 50 contains a transmission for transmitting drive from an electric motor 52 to the roller 40 so as to rotationally drive the roller.

The rollers 40 and 42 together define a nip 54 having a gap which is desirably slightly smaller than the thickness of the sheet material 12 on the roll 14. The sheet material 12 passes through the nip 54 so that rotation of the drive roller 40 and the driven roller 42 pulls the sheet material off of the roll 14 and dispenses it through the dispensing opening 44.

An activation sensor 56 may be mounted to the lower end 45 of the housing 16 (or, alternatively, to a module in the housing) adjacent a lens 58, as illustrated in FIG. 1. It will be understood, however, that the activation sensor 56 and/or lens 58, or any activations system known in the art, may be mounted in any area of the housing 16. The sensor 56 may be a conventional passive sensor for detecting infrared radiation. Passive infrared detectors are known in the art, and are described, for example, in U.S. Pat. No. 4,757,337. In practice, the sensor 56 is arranged to detect infrared radiation from a user's hand placed below the lens 58, and upon detecting the radiation, to transmit a signal for activating the electric motor 52 so as to dispense a length of sheet material through the dispensing opening 44.

In alternate embodiments, the sensor 56 may be an active device that emits an active signal to detect the presence of a user at or near the dispenser. Such active sensing systems are also well known to those skilled in the art.

Figure 7A:
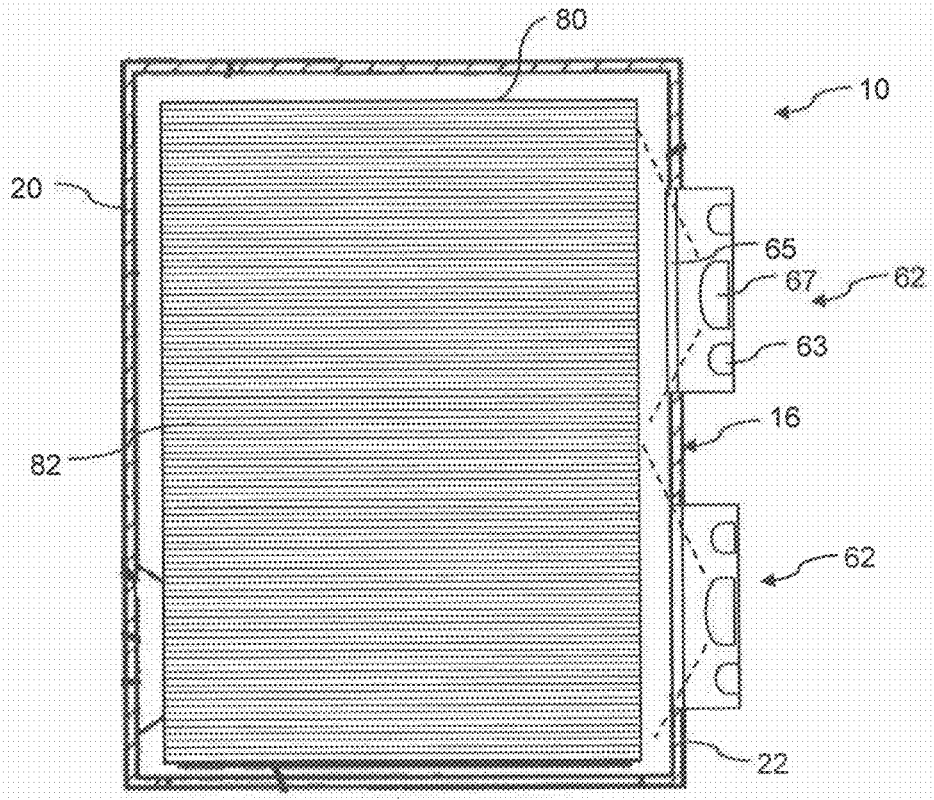
FIG. 7*a* is a front cut-away view of a stacked product dispenser incorporating a digital imager in accordance with aspects of the invention.
Figure 7B:
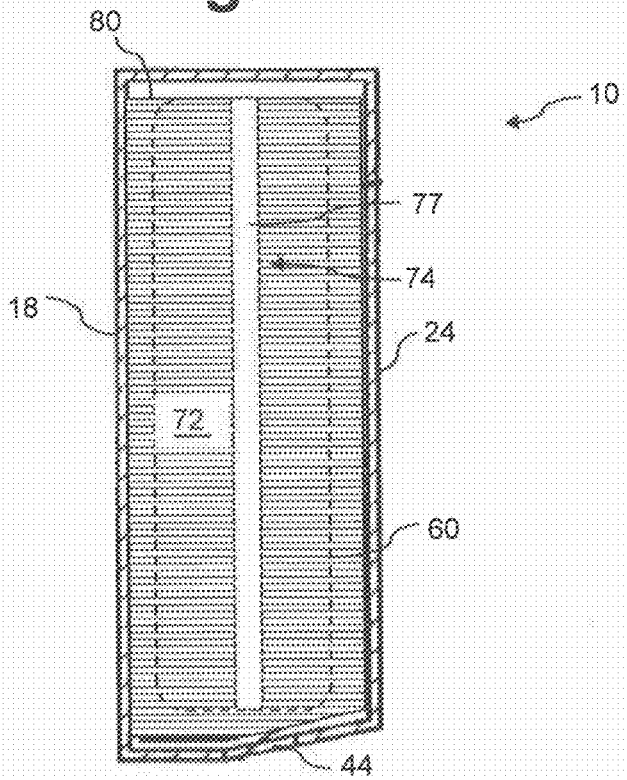
FIG. 7*b* is as side view of the stacked product dispenser indicating a digital image taken of a full stack, wherein the analyzed feature is a bright mark projected onto the side of the stack in the digital image.

Aspects of the present system and method embodiments utilize digital imagining and processing techniques that are known to those skilled in the art of digital imagery. Referring to the figures in general and discussed in greater detail below, one or more digital imaging systems ("imaginer") 62 are utilized with a dispenser system 10 to generate a digital image 60 (e.g., FIGS. 5*a* and 5*b*) of an aspect of a paper product formation, such as the rolled 14 or a stacked product 80, in a dispenser 16. The digital imager 62 may be include any suitable and commercially available digital camera 67 having a sufficient pixel density and resolution for the purposes described herein, as well as an associated light source 63, such as an array of one or more LED bulbs 63, and a mask 65 to create either a shadow mark 75 or bright mark 77, as discussed above. The digital imager 62 may be mounted and oriented within the dispenser housing at a location to periodically generate the digital image 60 of an aspect of the paper product formation 14, 80, such as the side aspect 72. FIGS. 4 and 7*b* show in dashed lines the field of the digital image taken by the imagers 62 relative to the side 72 of the paper product formations 14, 80. The digital imagers 62 may be mounted completely within the dispenser housing 16, or may be mounted to the outside of the housing 16 with a lens that protrudes through a side wall 20, 22 of the housing, as depicted in the embodiment of FIG. 7*a*.

The digital images taken by the imagers 62 are transmitted to a digital image processor 64 (FIGS. 5*a* and 5*b*), which may be incorporated directly as a component of the dispenser system 10 or remotely located and common to a plurality of dispensers 16. The digital image processor 64 is configured with sufficient processing capability to analyze and differentiate pixels that define an edge or other changing aspect of the paper product formation captured in the digital image 60, such as the outer edge of the projected mark 74 generated by the digital imager 62 as discussed above. In some embodiments as described herein, the digital image processor 64 may conduct a count of pixels corresponding to the surface area of the projected mark 74 captured in the digital image 60. The digital imager processor 64 may also determine a dimensional value of the projected mark 74 captured in the digital image 60 that changes as the paper product is depleted, such as the length (L) of the projected shadow mark 75 in FIGS. 5*a* and 5*b*, or length (L) of the bright mark 77 in FIGS. 6*a* and 6*b* projected onto the rolled product 14. For example, by differentiating the pixels in the image 60 that define the outer (changing) limit of the dimensional feature, the processor 64 can measure and apply a value to a line drawn from a fixed point in the image to the changing limit. This value can then be compared to known values corresponding to a full or other defined state of the paper product formation 14, 80, such as values that define stages of depletion of the products 14, 80, to calculate the amount of paper product that has been depleted or the amount that remains in the paper product formation 14, 80. This calculation may be an approximation based on known values, and interpolation between two known values, or an exact calculation based on the measured value of the dimension.

Thus, embodiments may rely on known edge detection techniques in digital image processing, which are mathematical methods that identify points in the image at which brightness changes relatively sharply (e.g., brightness discontinuities). The result of applying an edge detector technique to an image leads to a set of connected curves that indicate boundaries of objects in the image. Applying an edge detection algorithm to an image may significantly reduce the amount of data to be processed and filter out information that is less relevant, while preserving important structural properties of an image. The edges extracted from a two-dimensional image of a three-dimensional object can be classified as either viewpoint dependent or viewpoint independent. Relevant to the present disclosure, a viewpoint independent edge typically reflects inherent properties of the three-dimensional object, such as surface markings and surface shape. A typical edge might be the border between a block of red color against a yellow or white background.

There are many methods for edge detection, but most are grouped into two categories, search-based and zero-crossing based. The search-based methods detect edges by first computing a measure of edge strength, usually a first-order derivative expression such as the gradient magnitude, and then searching for local directional maxima of the gradient magnitude using a computed estimate of the local orientation of the edge, usually the gradient direction. The zero-crossing based methods search for zero crossings in a second-order derivative expression computed from the image in order to find edges, usually the zero-crossings of the Laplacian or the zero-crossings of a non-linear differential expression.

As a pre-processing step to edge detection, a smoothing stage, typically Gaussian smoothing, is almost always applied. Known edge detection methods mainly differ in the types of smoothing filters that are applied and the way the measures of edge strength are computed. As many edge detection methods rely on the computation of image gradients, they also differ in the types of filters used for computing gradient estimates in the x- and y-directions.

It should be appreciated that those skilled in the art of digital image processing are well versed in techniques that may be implemented for purposes of the present invention.

Figure 5A:
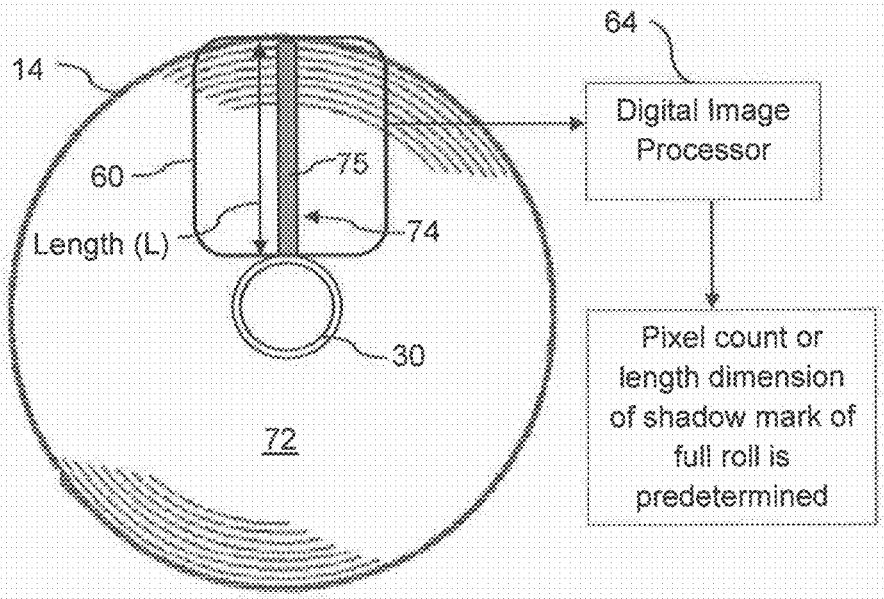
FIGS. 5*a* and 5*b* are side views of a rolled product formation indicating a digital image taken of a full roll and a partially depleted roll, wherein the analyzed feature is the length dimension or pixel count of a shadow mark projected onto the side of the roll.
Figure 5B:
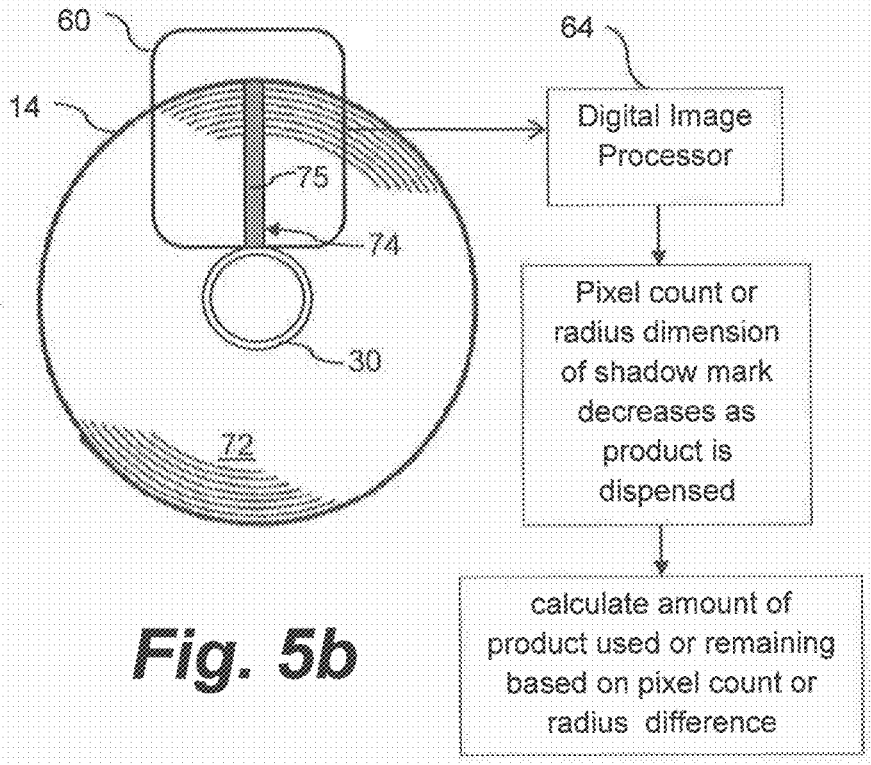

FIGS. 5*a* and 5*b* related to a method and system embodiment relevant to the rolled product dispensing system 10 depicted in FIGS. 3 and 4. FIG. 5*a* illustrates the side 72 of the roll paper formation 14. The digital imager 62 in FIG. 1 is disposed above the roll hub 32 and roll holder 36 so as to capture the digital image 60 depicted in FIG. 5*a*. The digital image 60 essentially captures a surface area 70 of the rolled product formation 14 at a full condition of the product 14. In this particular embodiment, the analyzed feature of the product formation 14 that changes as the paper product is depleted may be the length (L) of the projected mark 74, in this case the shadow mark 75, or a total pixel count of the shadow mark 75.

Still referring to FIG. 5*a*, the digital image 60 may be transmitted to the digital image processor 64 via a wired or wireless connection depending on the location of the digital image processor. In this regard, the digital imager 62 includes sufficient hardware/software to carry out projection of the mark 74 and transmission of the image 60 to the digital signal processor 64 in the event that the processor 64 is not incorporated as a component of the digital imager 62. An initial pixel count is conducted by the processor 64 of the surface area of the projected mark 74 captured in the image 60 that corresponds to the full roll. This may be done in a calibration step, with the results stored in the processor 64. Thus, this total pixel counts of the projected mark 74 within the image 60 for a full rolled product 14 is predetermined and stored in the digital image processor 64. The same type of calibration step may be conducted to determine the length of the projected mark 74 at various stages of depletion of the rolled product 14, wherein the defining edge of the mark is detected by pixel differentiation by the processor 64.

FIG. 5*b* illustrates the rolled product formation 14 in a partially depleted state. It can be appreciated that the size (field) of the digital image 60 remains the same while the amount of surface area of the rolled product 14 within the digital image 60 has decreased, with the size of the projected shadow mark 75 decreasing accordingly. The digital image 60 is transmitted to the image processor 64, wherein a pixel count of the surface area of the mark 75 may be conducted. By knowing the reduction in the size of the mar 75 within the digital image 60 and the pixel count of a full rolled product 14 from the steps depicted in FIG. 5*a*, a calculation can be readily made to determine the amount of paper product that has been used, or correspondingly the amount of paper product remaining on the rolled product formation 14. It should be appreciated that these calculations may be predetermined and stored so that the processor 64 need only to compare a pixel count from the image depicted in FIG. 5*b* to one of the stored values to calculate the amount of product that has been used. For example, the pixel count of the mark 75 from the image 60 in FIG. 5*b* may fall within a certain predefined range, wherein this range indicates that about 30% of the product has been depleted.

Still referring to FIGS. 5*a* and 5*b*, it can be appreciated that a sufficient color difference must exist between the projected shadow mark 75 and the paper product background in the digital image 60 in order to differentiate the surface area pixels of the shadow mark 75 from the background pixels. In this regard, the side 72 of the rolled product formation may be enhanced for this purpose, as discussed above. The light sources 63 of the digital imager 62 may sufficiently light the background surface area of the rolled product formation 14 for this purpose, or the entire side aspect 72 may be painted, sprayed, or otherwise applied with a lighter pigment or color as compared to the shadow mark 75. Additionally, the components within the dispenser 16 that lie in the field of image 60 may be rendered darker or lighter (depending on whether a shadow mark 75 or a bright mark 77 is projected) as compared to the side 72 of the rolled product formation 14 in order that a sufficient pixel value differentiation exists.

Figure 6A:
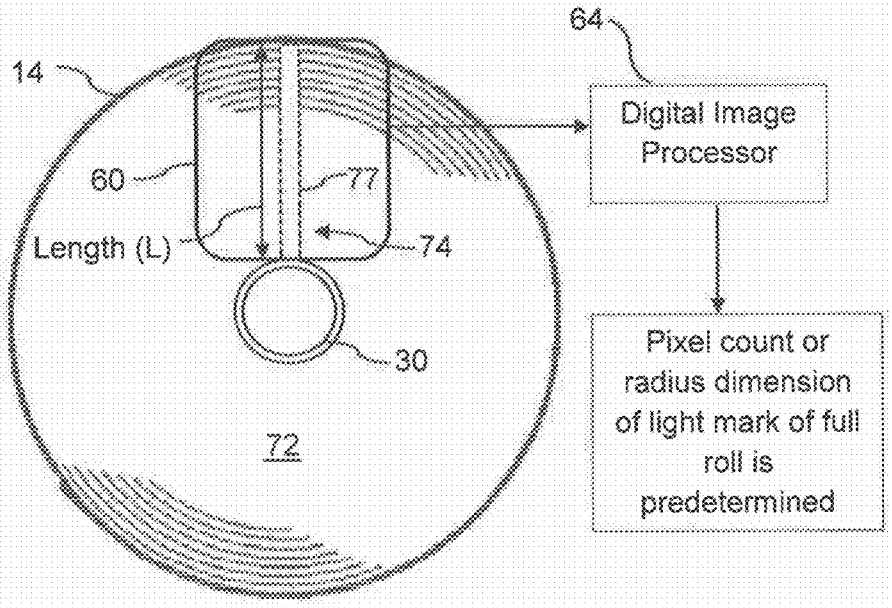
FIGS. 6*a* and 6*b* are side views of a rolled product formation indicating a digital image taken of a full roll and a partially depleted roll, wherein the analyzed feature is the length dimension or pixel count of a bright mark projected onto the side of the roll.
Figure 6B:
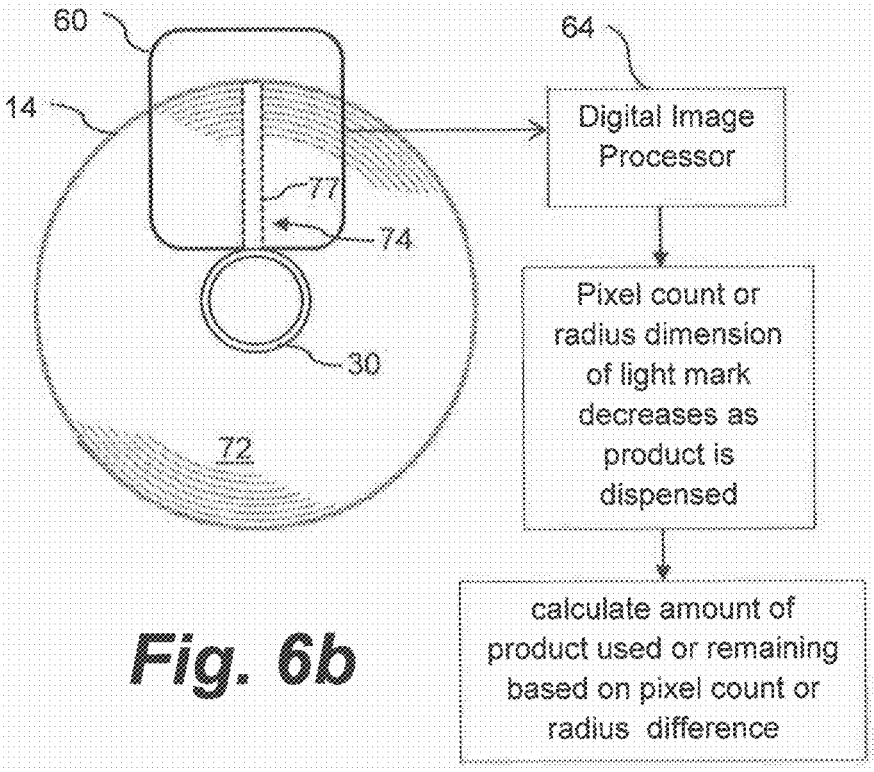

FIGS. 6*a* and 6*b* depict an embodiment similar to that of FIGS. 5*a* and 5*b*, with the exception that the projected mark 74 is a bright mark 77 that contrasts with a sufficiently darker background of the rolled product formation 14. Again, the analyzed feature that changes as the product formation 14 decreases in size may be the length of the bright mark 77, or the count of surface area pixels of the bright mark 77. As discussed above, projection of a bright mark 77 may be preferred if the paper product is a darker color. Additionally, the entire side aspect 72 may be painted, sprayed, or otherwise applied with a darker pigment or color as compared to the bright mark 77. Additionally, the components within the dispenser 16 that lie in the field of image 60 may be rendered darker as compared to the side 72 of the rolled product formation 14 in order that a sufficient pixel value differentiation exists.

FIGS. 7*a* through 8*b* depict a dispensing system 10 that is configured for dispensing a stacked paper product formation 80, such as a stack of interleaved and folded paper towels 82. FIG. 7*b* depicts the side aspect of the dispenser system 10 wherein the side 72 of the stacked product formation 80 is visible, as well as the field of the digital image 60. In FIG. 7*a* it can be appreciated that multiple digital imagers 62 (with associated digital camera 67, mask 65, and one or more light sources 63) may be aligned along the side 22 of the dispenser 16, wherein the respective images of the individual imagers 62 are combined to generate the digital image 60 depicted in FIGS. 8*a* and 8*b*.

Figure 8A:
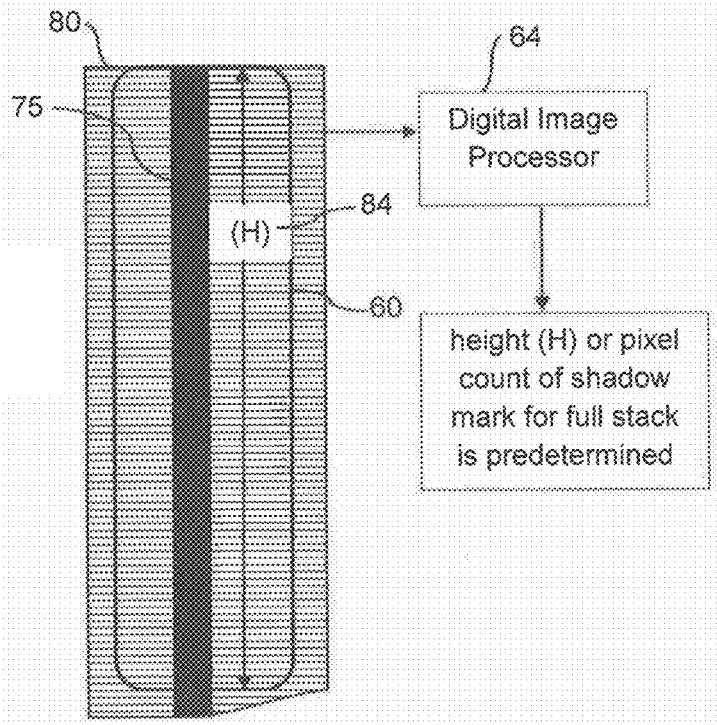
FIGS. 8*a* and 8*b* are side views of a stacked product indicating a digital image taken of a full stack and a partially depleted stack, wherein the analyzed feature in the digital image is the height or pixel count of a shadow mark projected onto the side of the stacked product formation.
Figure 8B:
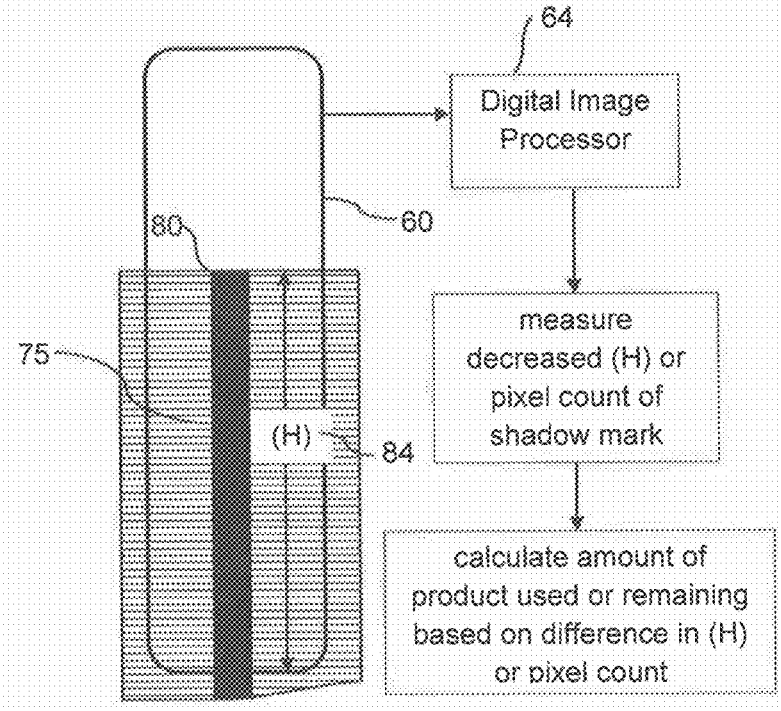

Referring to FIGS. 8*a* and 8*b*, the analyzed feature that changes as the stacked product formation 80 is depleted is a dimensional value 84 (e.g., height (H)) or pixel count corresponding to the shadow mark 75 captured in the image 60. The height 84 or pixel count is predetermined and known for a full stack, as depicted in FIG. 8*a*. FIG. 8*b* depicts a partially depleted condition of the stack 80 captured within the field of the digital image 60. The digital image processor 64 may count the total pixels corresponding to the mark 75 or differentiate the pixels corresponding to the top edge of the depleted stack 80 and make a determination of the height value 84 from a fixed point in the image to this top edge. By comparing this reduced height value to the known value for a full stack or other known depletion state of the stack, a calculation can be readily made as to the amount of product used or remaining based on the difference in height values. As with the other embodiments, these calculations may be predetermined and stored in the digital processor wherein the closest stored value is retrieved or an interpolation is made between two of the saved values, or an exact calculation is conducted at the time of capturing the digital image 60.

Figure 9:
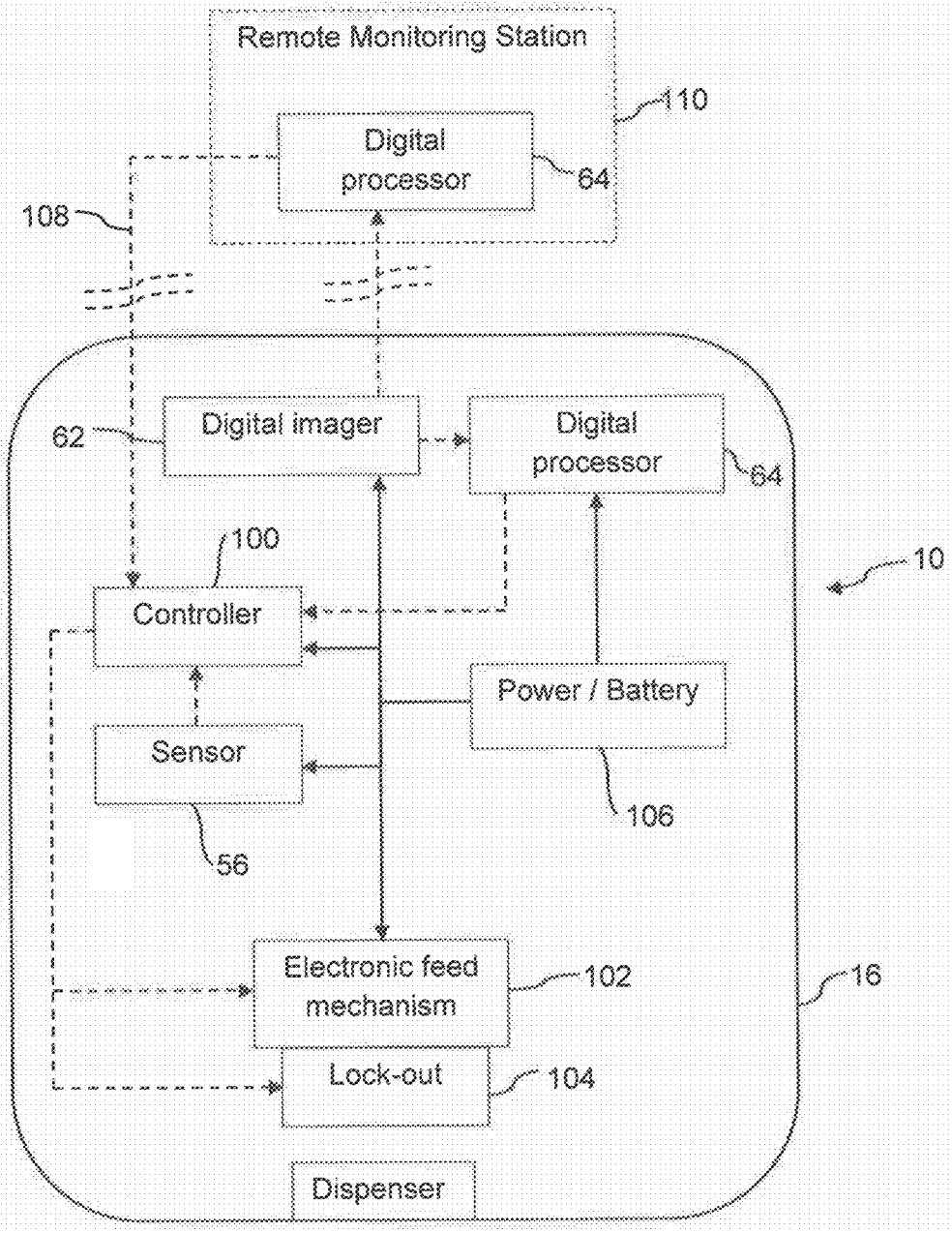
FIG. 9 is a diagram view of control functions and components of a dispenser incorporating features of the present invention.

FIG. 9 is a diagram illustrating various component functionalities of the systems and method. In the illustrated embodiment, the system 10 includes the dispenser 16 having the digital processor 64 and imager 62 incorporated with the individual dispenser 16. Power is supplied externally or internally via a battery 106 to the various components, including the digital processor 64, digital imager 62, dispenser controller 100, sensor 56, and an electronic feed mechanism 102. As discussed above, aspects of the present method and system may be incorporated with any manner of conventional dispenser utilizing conventional electronic feed mechanisms 102. A lock-out feature 104 may be incorporated within the feed mechanism 102 and prevents dispensing of paper product from the dispenser until certain conditions are satisfied.

While the present invention has been described in connection with certain preferred embodiments it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method for determining an amount of product in product formation, wherein the product is being depleted from or added to the product formation in a continuous or periodic manner, the method comprising:

at defined intervals, projecting a mark with a light source imager onto an aspect of the product formation that changes as the amount of product is depleted or added to the product formation;

taking a digital image of the aspect of the product formation that captures the projected mark, and transmitting the digital image to a digital imager processor;

with the digital image processor, analyzing a feature of the projected mark that changes as the product formation decreases or increases in size as the product is dispensed or added; and comparing the analyzed feature with a predetermined value of the feature at a predefined size of the product formation to determine an actual amount of the product on the product formation, or amount of product depleted from or added to the product formation.

2. The method as in claim 1, wherein the analyzed feature is a dimensional value or pixel count of the projected mark that changes as the product formation decreases or increases in size, wherein a changing pixel count or dimensional value of the projected mark is a measure of the amount of product added or depleted from the product formation.

3. The method as in claim 2, wherein the projected mark is a shadow mark produced by the light source imager against a sufficiently brighter background of the product formation in the digital image to produce definable pixels that are detectable by the digital image processor for determining the pixel count or dimensional value of the shadow mark.

4. The method as in claim 2, wherein the projected mark is a bright mark produced by the light source imager against a sufficiently darker background of the product formation in the digital image to produce definable pixels that are detectable by the digital image processor for determining the pixel count or dimensional value of the shadow mark.

5. The method as in claim 1, wherein product formation is a rolled or stacked product, and the digital image is taken of a side of the product formation that changes in size as the product formation decreases or increases in size.

6. The method as in claim 5, wherein the product formation is a stack of folded products, the projected mark extending from a lower bottom portion of the stack towards an upper edge of the stack.

7. The method as in claim 5, wherein the product formation is a roll of continuous product, the mark extending radially from a center portion of the side towards a circumferential edge of the roll.

8. A method for determining an amount of paper product in a product formation that is housed and dispensed from a dispenser, the method comprising:

at defined intervals, projecting a mark with a light source imager onto an aspect of the paper product formation within the dispenser that changes as the paper product is dispensed from the dispenser;

taking a digital image of the aspect of the paper product formation that captures the projected mark, and transmitting the digital image to a digital imager processor;

with the digital image processor, analyzing a feature of the projected mark that changes as the paper product formation decreases in size as the product is dispensed; and comparing the analyzed feature with a predetermined value of the feature at a predefined size of the paper product formation to determine an actual amount of the paper product in the product formation or amount of paper product dispensed from the product formation.

9. The method as in claim 8, wherein the method is utilized with a paper towel or toilet tissue dispenser.

10. The method as in claim 8, wherein the analyzed feature is a dimensional value or pixel count of the projected mark that changes as the paper product formation decreases in size, wherein a changing pixel count or dimensional value of the projected mark is a measure of the amount of product dispensed from the paper product formation.

11. The method as in claim 10, wherein the projected mark is a shadow mark produced by the light source imager against a sufficiently brighter background of the paper product formation in the digital image to produce definable pixels that are detectable by the digital image processor for determining the pixel count or dimensional value of the shadow mark.

12. The method as in claim 10, wherein the projected mark is a light mark produced by the light source imager against a sufficiently darker background of the paper product formation in the digital image to produce definable pixels that are detectable by the digital image processor for determining the pixel count or dimensional value of the shadow mark.

13. The method as in claim 10, wherein the product formation is a rolled or stacked formation of the paper product within the dispenser, and the digital image is taken of a side of the product formation that changes as the product formation decreases in size.

14. The method as in claim 13, wherein the product formation is a stack of folded paper products, the projected mark extending from a lower bottom portion of the stack of folded paper products towards an upper edge of the stack.

15. The method as in claim 13, wherein the product formation is a roll of continuous paper product, the mark extending radially from a center portion of the side towards a circumferential edge of the roll.

* * * * *